United States Patent [19]

Kirkup

[11] 4,110,719

[45] Aug. 29, 1978

[54] THREE PHASE CIRCUIT BREAKER

[75] Inventor: Joseph F. Kirkup, Parma, Mich.

[73] Assignee: Mechanical Products, Jackson, Mich.

[21] Appl. No.: 786,062

[22] Filed: Apr. 11, 1977

[51] Int. Cl.[2] ..... H01H 71/16

[52] U.S. Cl. ..... 337/46; 337/66

[58] Field of Search ..... 337/46, 47, 48, 49, 337/50, 62, 66

[56] References Cited

U.S. PATENT DOCUMENTS

| | | | |
|---|---|---|---|
| 2,813,168 | 11/1957 | Mascioli et al. | 337/46 |
| 3,211,862 | 10/1965 | Ellenberger | 337/46 |
| 3,990,028 | 11/1976 | Aust et al. | 337/46 |
| 4,024,487 | 5/1977 | Krasser et al. | 337/46 |

*Primary Examiner*—Harold Broome

*Attorney, Agent, or Firm*—Harness, Dickey & Pierce

[57] ABSTRACT

The disclosure relates to a three phase aircraft circuit breaker in which a single push-pull manual operator controls a single mechanical latch for the three poles. Slidable contact carriers in each of the phases are controlled by thermally actuated latches in each of the poles which are released upon the occurrence of an electrical overload by a current responsive bimetal in each pole. An ambient temperature responsive bimetal is provided in each phase. A common trip mechanism effects opening of all poles of the circuit breaker upon the occurrence of an overload in any phase.

6 Claims, 6 Drawing Figures

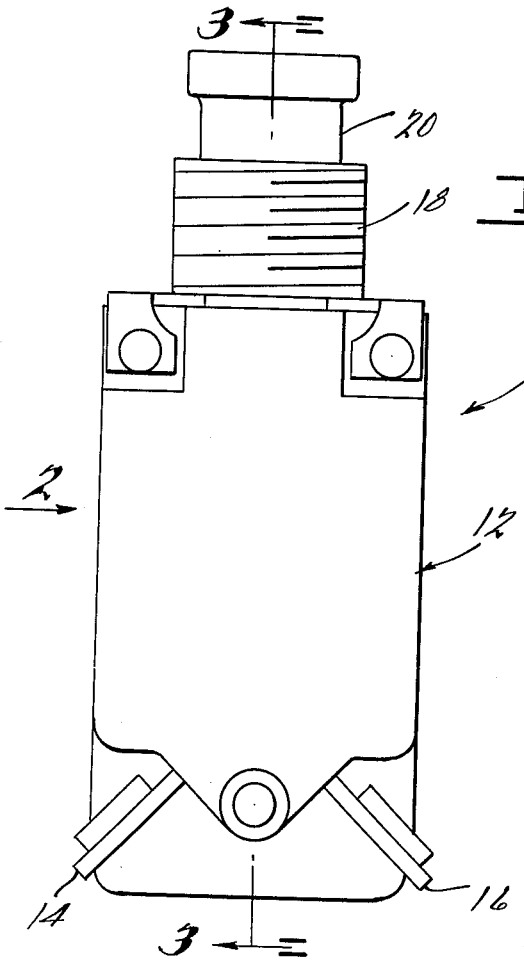
Fig. 1.
Fig. 2.
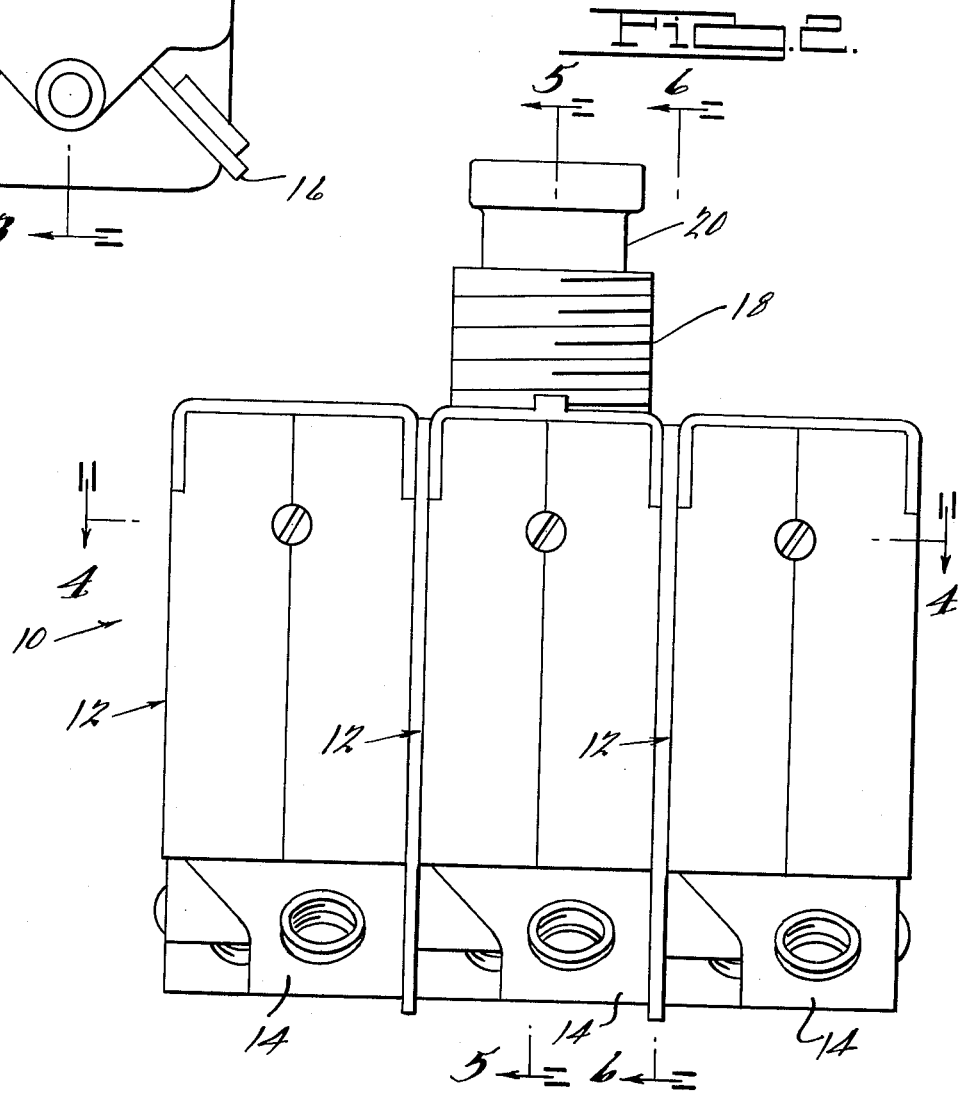

THREE PHASE CIRCUIT BREAKER

BACKGROUND OF THE INVENTION

The instant invention relates to an improved, three phase circuit breaker of the general type disclosed in U.S. Pat. Nos. 3,287,523; 3,416,113; 3,629,762 and 3,629,763, which are assigned to the assignee of the instant invention. Reference should be made to the aforesaid patents for a detailed discussion of elements and the operation thereof some of which are common to the circuit breaker of the instant invention.

SUMMARY OF THE INVENTION

The invention lies in the provision of a novel common trip linkage which mechanically interconnects three single phase circuit breakers to form a three phase circuit breaker. The common trip linkage is connected to and supported by the contact carrier of the center pole of the three phase circuit breaker. The common trip linkage supports the thermal latches for the outer phases as well as a common trip arm which effects opening of all poles upon the occurence of an overload in any one pole.

IN THE DRAWINGS

FIG. 1 is an end elevational view of an improved circuit breaker in accordance with the instant invention;

FIG. 2 is a side elevational view;

DETAILED DESCRIPTION OF THE PREFERRED EMBODIMENT

Figure 4:
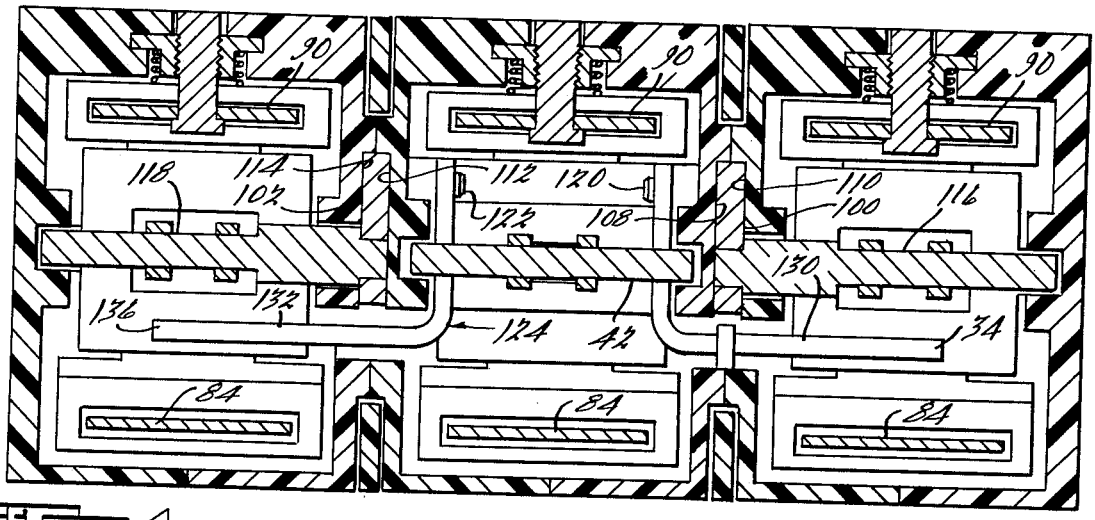
FIG. 4 is a cross sectional view taken substantially along the line 4—4 of FIG. 2.

As seen in FIG. 1, a three phase circuit breaker 10, in accordance with an exemplary constructed embodiment of the instant invention, comprises three single pole enclosures 12 each having a pair of terminals 14 and 16 thereon which extend exteriorly of the enclosure 12 for connection to an electrical source. A threaded ferrule 18 extends exteriorly of the center enclosure 12 for the guidance of a manual operator 20. The ferrule 18, in conjunction with a nut (not shown), provides a mounting means for the circuit breaker 10 on a panelboard (not shown).

Figure 5:
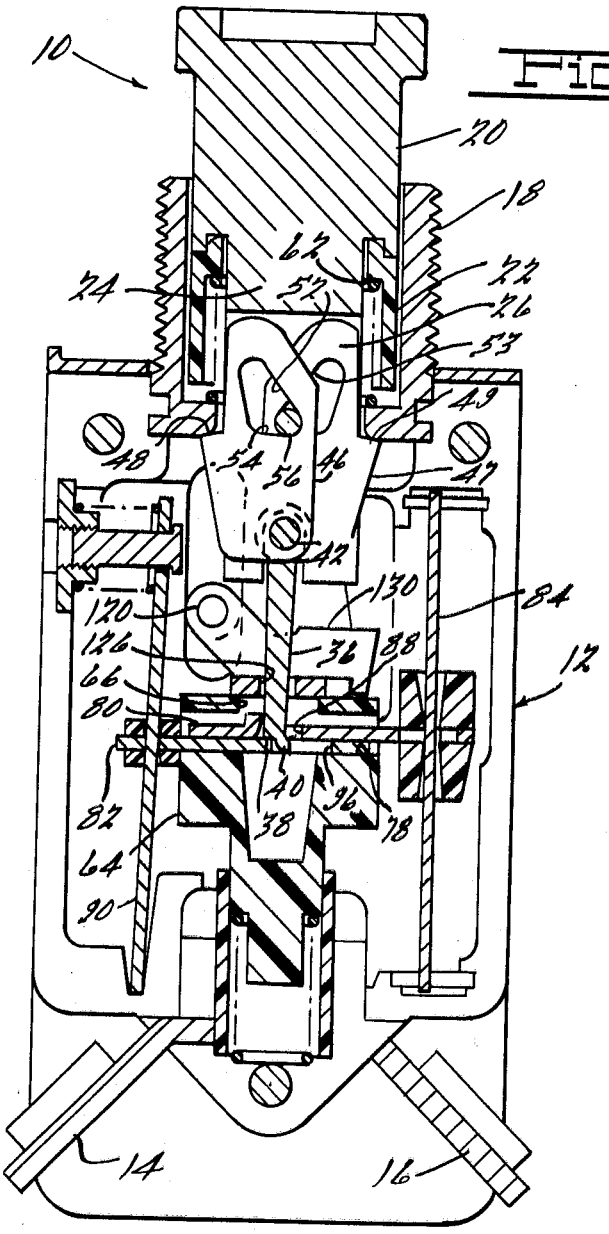
FIG. 5 is a cross sectional view taken substantially along the line 5—5 of FIG. 2.

As best seen in FIG. 5, the manual operator 20 is provided with a trip indicator 22. The manual operator 20 and trip indicator 22 are capable of sliding axial movement with respect to the ferrule 18.

The manual operator 20 is provided with a central portion 24 having a central slot 26 extending approximately half the length thereof.

Figure 3:
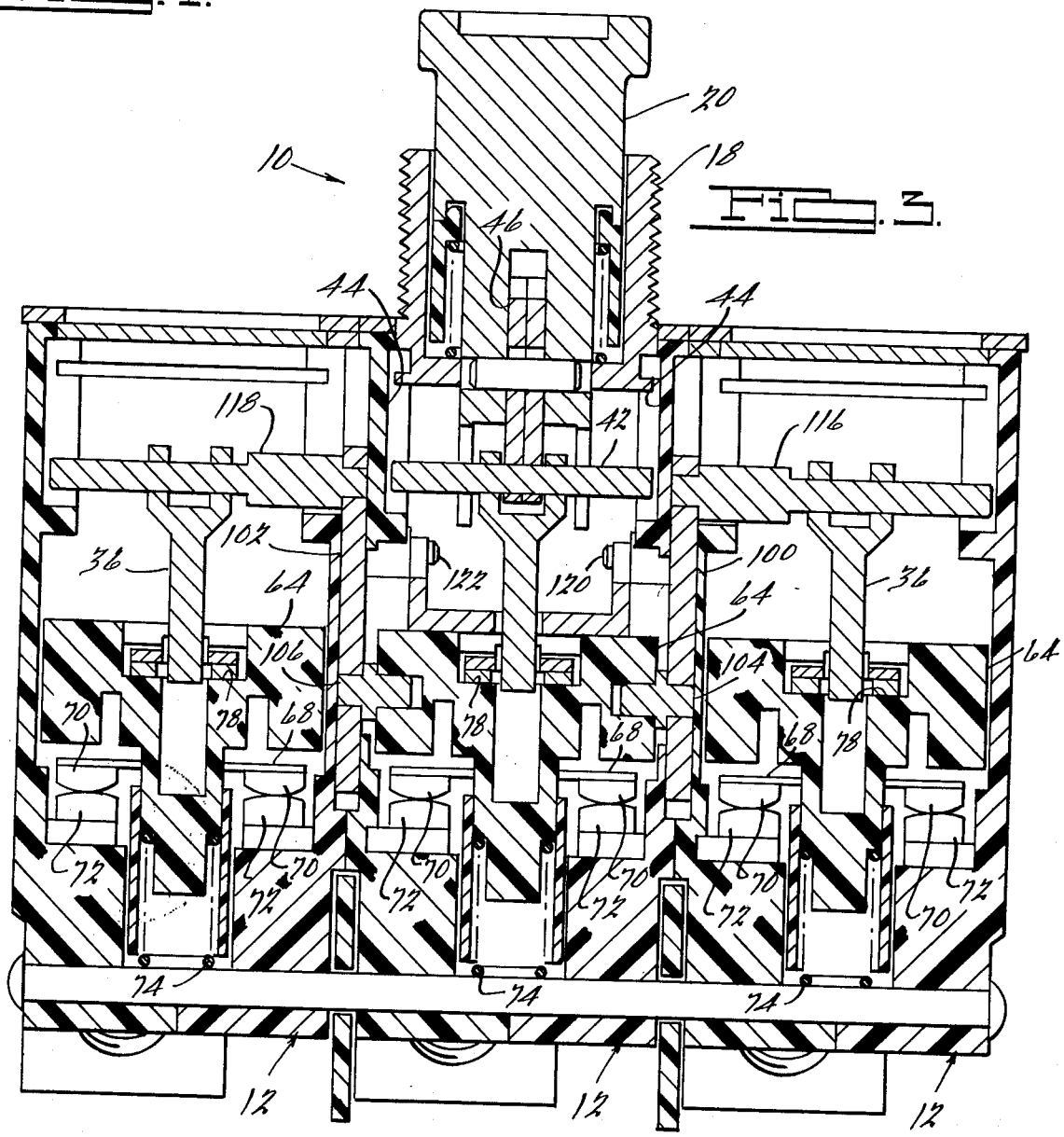
FIG. 3 is a cross sectional view taken substantially along the line 3—3 of FIG. 1.

A clevis or thermal latch element 36 is provided with a latch surface 38 and a depending portion 40. The clevis 36 is pivotally supported by a pin 42 which is movable relative to the manual operator 20 in a slot 43. As can be seen in FIG. 3, the end portions of pin 42 are retained within grooves 44 in the central housing 12 which guide axial movement thereof.

A pair of mechanical latch elements 46 and 47 are pivotally supported by the pin 42 and are accepted in the slot 26 in the manual operator 20. The latch members 46 and 47 are provided with latching surfaces 48 and 49 which are adapted to engage a cooperating latching surface 50 on the ferrule 18.

The mechanical latch elements 46 and 47 have apertures therein defining camming surfaces 52 and 53 which are disposed at an acute angle with respect to the axis of reciprocation of the manual operator 20 thereby to effect manual opening of the circuit breaker 10. Lower camming surfaces 54 and 55 are disposed at substantially a right angle with respect to the axis of reciprocation of the manual operator 20 to provide positive locking of the circuit breaker 10. The central stem portion 24 carries a camming pin 56 which extends across the slot 26 therein and through the camming apertures of the mechanical latch members 46 and 47 so as to be in operative engagement therewith.

A spring 62 is provided to resiliently bias the manual operator 20, clevis 36 and latch 46 upwardly with respect to the ferrule 18.

A movable contact carrier or plunger 64 has a central opening 66 therein for acceptance of the clevis 36. As best seen in FIG. 3, the contact carrier 64 carries a contact bridge 68 having a pair of movable contacts 70 positioned thereon. The movable contacts 70 are engageable with fixed contacts 72 to complete a circuit from terminal 14 to terminal 16 through a current responsive bimetal element of the circuit breaker 10, as will be described. A helical coil spring 74 abuts against the housing 12 at one end and the movable contact carrier 64 at its other end so as to normally bias the contact carrier 64 upwardly relative to the housing 12.

Each contact carrier 64 has a laterally extending slot 78 therein for the acceptance of a thermal or overload latch slide 80 and an ambient temperature slide 82. The overload slide 80 is movable internally of the contact carrier 64 under the influence of an elongated current responsive bimetal 84. The slide 80 is provided with a slot 88 which accepts and closely cooperates with the clevis 36 to effect pivoting thereof in response to lateral movement of the slide 80.

The ambient temperature slide 82 underlies the slide 80 and is movable internally of the contact carrier 64 under the influence of an elongated ambient temperature compensating bimetal 90. The ambient temperature responsive bimetal 90 is interlocked to the slide 82 whereby lateral movement of the slide 82 is controlled by the bimetal 90. The latch slide 82 is provided with a slot 96, which, when the circuit breaker is in the contact's closed position, accepts the hooked end 40 of the clevis 36. In the contact's closed position, the latch surface 38 of the clevis 36 engages the upper surface of the slide 82 adjacent the periphery of the slot 96 with a pressure determined by the upward resilient bias provided by spring 74.

In accordance with the present invention, common trip of the three poles 12 of the circuit breaker 10 is achieved by a common trip linkage which is carried by the contact carrier 64 in the center pole 12. The common trip linkage comprises a pair of side plates 100 and 102 which are pinned to the center contact plunger 64 by pins 104 and 106, respectively. The side plates 100 and 102 are guided for vertical movement in recesses 108 and 110 in the center pole 12 and in an adjacent pole 12, respectively, and by similar recess 112 and 114 in the center pole 12 and in an adjacent pole on the opposite side of the center pole 12. The side plates 100 and 102 support cantilevered clevis support pins 116 and 118 at the upper ends thereof each of which support a clevis 36. The pins 116 and 118 function in the manner of the pin 42 in the center pole 12 of the circuit breaker 10 for the pivotal support of the clevises 36 in the outermost poles.

As best seen in FIGS. 3 and 4 of the drawings, a pair of common trip bar support pins 120 and 122 are carried by the side plates 100 and 102 for the pivotal support of a common trip crossbar 124. The common trip crossbar is pivotable about the pins 120 and 122 so as to bring a trip surface 126 (FIG. 5), thereof into engagement with the clevis 36 in the center pole 12 of the circuit breaker 10. The trip surface 126 comprises the inner wall of an aperture in a cross member portion 128 of the crossbar 124 which connects a pair of generally L-shaped arms 130 and 132. End portions 134 and 136 of the arms 130 and 132 are engageable with the top surface of the contact carriers 64 in the outer poles 12 so as to rotate the common trip bar 124 counterclockwise, as seen in FIG. 5 of the drawings, thereby to bring the surface 126 into engagement with the clevis 36 so as to rotate the clevis 36 counterclockwise about its support pin 42 and effect release of its associated contact carrier 64.

Figure 6:
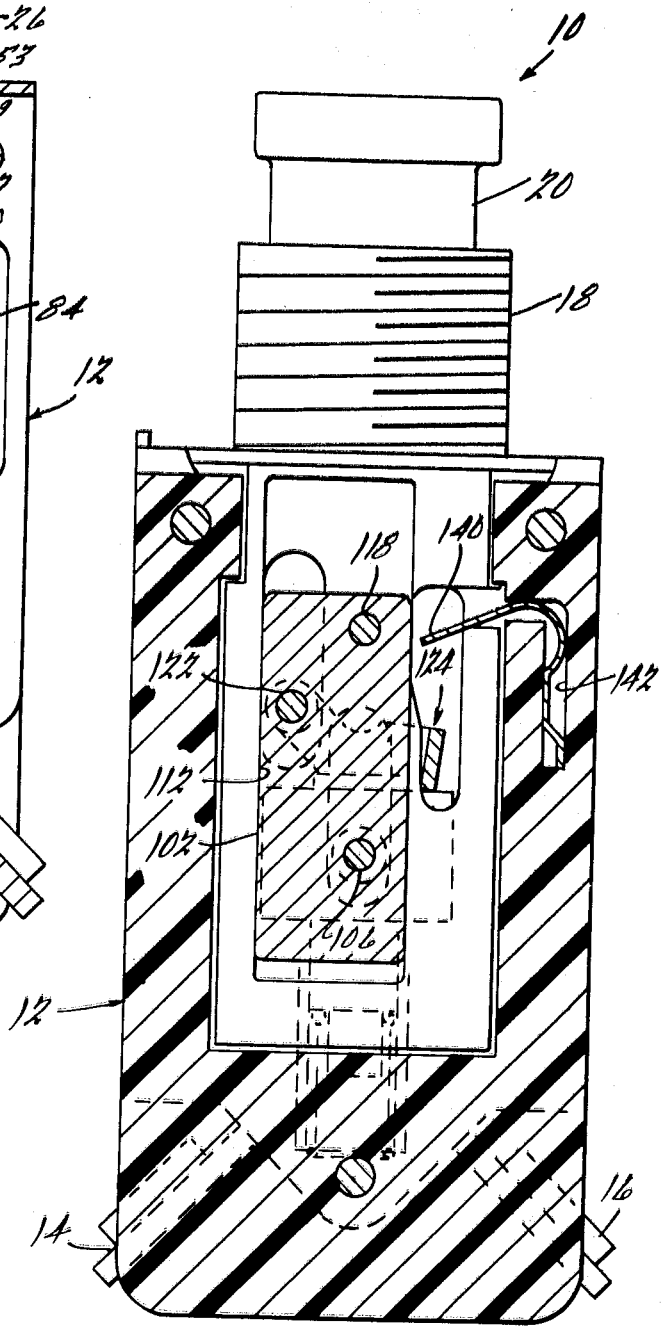
FIG. 6 is a cross sectional view taken substantially along the line 6—6 of FIG. 2.

Referring to FIG. 6 of the drawings, a relatch spring 140 is supported in a complementary recess 142 to effect clockwise rotation of the common trip member 124 thereby to bias the center clevis 36 clockwise, as seen in FIG. 5 of the drawings, to condition the clevis 36 for latching engagement on the latch slide 82.

From the foregoing it should be apparent that the center phase 12 of the circuit breaker 10 is provided with a common manually operable mechanical latch for all three phases or poles 12. When the center phase 12 is opened manually, the outer phases are also opened due to coupling of the clevise 36 by the common trip linkage due to the common trip bar 124.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. A three phase electrical circuit breaker comprising:

a pair of external terminals for each of said poles for connection to a source of electrical current, a fixed internal contact in each of said poles connected to one of said terminals, current responsive means in each of said poles electrically connected to the other of said terminals, a contact carrier in each of said poles having a movable contact thereon and movable between a closed and open condition with respect to said fixed internal contact to make or break an electrical circuit through said poles, and a thermal latch element in each of said poles for maintaining the contact carrier therein in the closed condition, said thermal latch being controlled by said current responsive means so as to effect release of said latch permitting said contact carrier to move to the contact's open condition, and a common trip linkage carried by the contact carrier in one of said poles, said common trip linkage comprising means for supporting the thermal latch element in the other poles of said circuit breaker.

2. A common trip linkage for a three phase electrical circuit breaker in accordance with claim 1 wherein said common trip linkage includes a common trip bar movable by the contact carrier in any pole of said circuit breaker to effect release of the thermal latch in all of the poles thereof.

3. A common trip linkage for a three phase electrical circuit breaker in accordance with claim 2 wherein said common trip bar is pivotally supported by the contact carrier in said one pole.

4. A common trip linkage for a three phase electrical circuit breaker in accordance with claim 3 wherein said common trip bar is rotated due to engagement with said contact carrier in either of said other poles thereby to cam the thermal latch in said one pole to the open condition.

5. A common trip linkage for a three phase electrical circuit breaker in accordance with claim 1 wherein the supporting means of said common trip linkage comprises cantilevered pins for pivotally supporting the thermal latches in said other poles.

6. A common trip linkage for a three phase electrical circuit breaker in accordance with claim 5 wherein pins are carried by side plates pinned to said contact carrier.

* * * * *